US010036983B2

(12) United States Patent
Abe et al.

(10) Patent No.: US 10,036,983 B2
(45) Date of Patent: Jul. 31, 2018

(54) FIXING DEVICE AND IMAGE FORMING APPARATUS WITH AN UPSTREAM-DOWNSTREAM TENSION DIFFERENCE

(71) Applicant: FUJI XEROX CO., LTD., Tokyo (JP)

(72) Inventors: Masaaki Abe, Kanagawa (JP); Yasufumi Suwabe, Kanagawa (JP); Nobuhiro Katsuta, Kanagawa (JP); Tokuya Sakamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/250,196

(22) Filed: Aug. 29, 2016

(65) Prior Publication Data

US 2017/0277085 A1 Sep. 28, 2017

(30) Foreign Application Priority Data

Mar. 25, 2016 (JP) ..... 2016-062378

(51) Int. Cl.
*G03G 15/20* (2006.01)

(52) U.S. Cl.
CPC ..... *G03G 15/2028* (2013.01)

(58) Field of Classification Search
CPC ..... G03G 15/2021; G03G 15/2028; G03G 15/6517
USPC ..... 399/331, 330, 328
See application file for complete search history.

(56) References Cited

U.S. PATENT DOCUMENTS

2006/0198670 A1* 9/2006 Baba ..... G03G 15/2053 399/323
2007/0065199 A1 3/2007 Matsuduki
2007/0242996 A1* 10/2007 Kobayashi ..... G03G 15/0131 399/394
2010/0086336 A1* 4/2010 Izawa ..... G03G 15/10 399/336
2013/0278945 A1* 10/2013 Ono ..... G03G 15/041 358/1.2
2014/0101960 A1* 4/2014 Kida ..... A24D 1/02 34/60
2015/0016852 A1* 1/2015 Katsuta ..... G03G 15/11 399/320
2015/0316876 A1* 11/2015 Takematsu ..... G03G 15/2028 399/322

FOREIGN PATENT DOCUMENTS

EP 1 580 621 A2 9/2005
JP 2005-266659 A 9/2005
JP 2007-057648 A 3/2007
JP 2007-079516 A 3/2007

* cited by examiner

*Primary Examiner* — Walter L Lindsay, Jr.
*Assistant Examiner* — Arlene Heredia Ocasio
(74) *Attorney, Agent, or Firm* — Oliff PLC

(57) ABSTRACT

An image forming apparatus includes a forming part that forms an image on a ribbon-like medium that is being transported; and a fixing part disposed downstream of the forming part in a medium transport direction, the fixing part including multiple fixing members, which are arranged in the transport direction and fix the image to the medium by applying heat and pressure to the medium. An upstream-downstream tension difference, in the medium transport direction, of the fixing member located on the most upstream side in the transport direction is greater than those of the other fixing members in the medium transport direction.

16 Claims, 5 Drawing Sheets

FIXING DEVICE AND IMAGE FORMING APPARATUS WITH AN UPSTREAM-DOWNSTREAM TENSION DIFFERENCE

CROSS-REFERENCE TO RELATED APPLICATIONS

This application is based on and claims priority under 35 USC 119 from Japanese Patent Application No. 2016-062378 filed Mar. 25, 2016.

BACKGROUND

Technical Field

The present invention relates to a fixing device and an image forming apparatus.

SUMMARY

According to an aspect of the present invention, there is provided an image forming apparatus including: a forming part that forms an image on a ribbon-like medium that is being transported; and a fixing part disposed downstream of the forming part in a medium transport direction, the fixing part including multiple fixing members, which are arranged in the transport direction and fix the image to the medium by applying heat and pressure to the medium. An upstream-downstream tension difference, in the medium transport direction, of the fixing member located on the most upstream side in the transport direction is greater than upstream-downstream tension differences of the other fixing members in the medium transport direction.

BRIEF DESCRIPTION OF THE DRAWINGS

Exemplary embodiment of the present invention will be described in detail based on the following figures, wherein.

DETAILED DESCRIPTION

Outline

Figure 1:
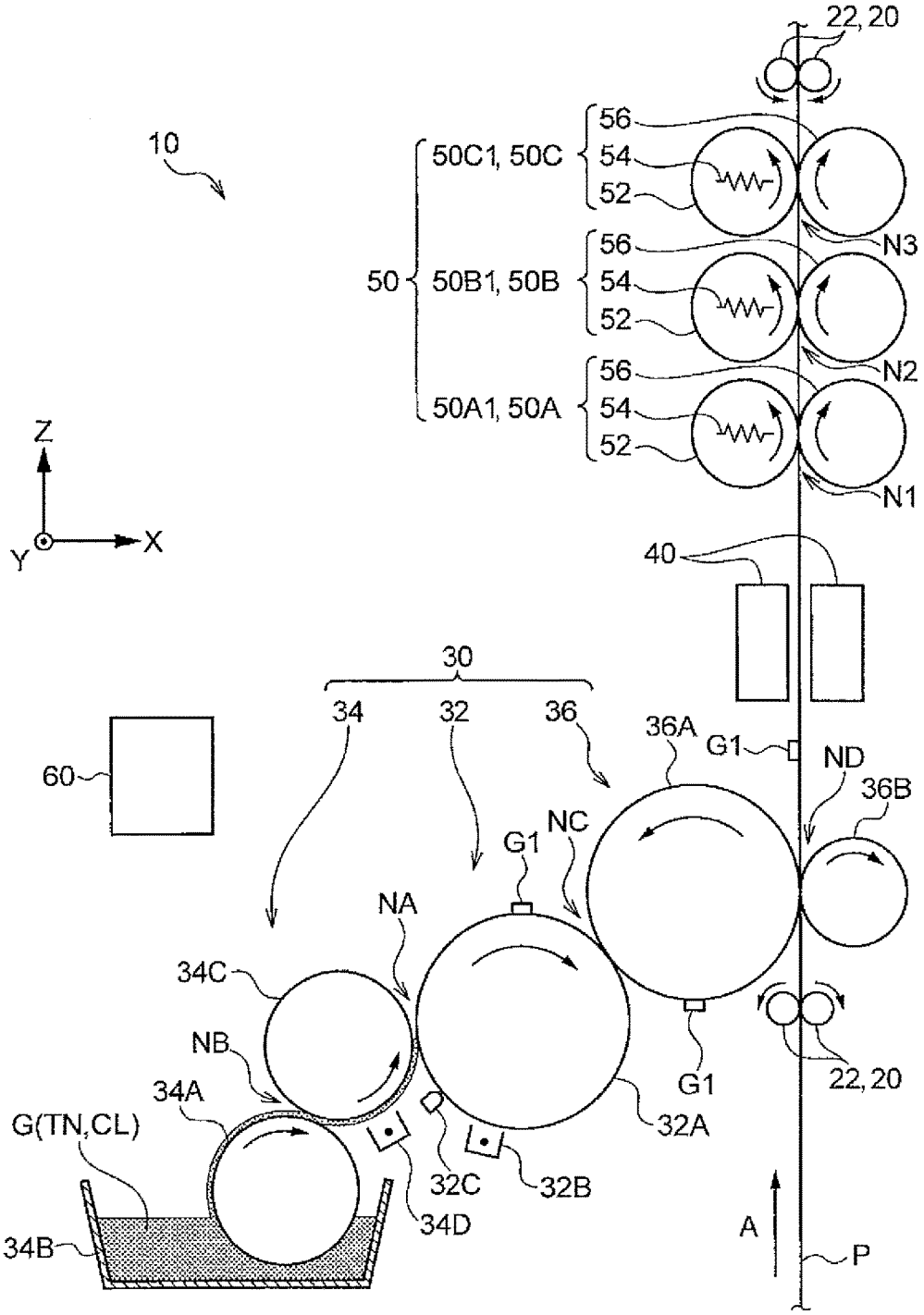
FIG. 1 is a schematic view (front view) of an image forming apparatus according to this exemplary embodiment.

An embodiment for implementing the present invention (hereinbelow, "this exemplary embodiment"), more specifically, the configuration, the operation, and the advantage of an image forming apparatus 10 according to this exemplary embodiment (see FIG. 1) will be described in this order below, with reference to the drawings. In the drawings, the direction indicated by an arrow X corresponds to the width direction of the image forming apparatus 10, the direction indicated by an arrow Y corresponds to the depth direction of the image forming apparatus 10, and the direction indicated by an arrow Z, which is perpendicular to both the width and depth directions of the apparatus, corresponds to the height direction of the image forming apparatus 10.

Configuration of Image Forming Apparatus

The configuration of the image forming apparatus 10 will be described below with reference to the drawings. The description of the configuration of the image forming apparatus 10 will be given with reference to FIG. 1, unless otherwise specified.

The image forming apparatus 10 according to this exemplary embodiment is, for example, an electrophotographic image forming apparatus that has a function of forming a toner image G1 on a medium P with a developer G and fixing the toner image G1 to the medium P, thus forming an image G2 on the medium P. Herein, the toner image G1 is an example of an image.

Developer

Herein, the image forming apparatus 10 according to this exemplary embodiment uses, for example, a liquid developer G that is formed by dispersing a powder toner TN in a carrier liquid CL. In other words, the developer G according to this exemplary embodiment contains the toner TN and the carrier liquid CL. The polarity of the toner TN according to this exemplary embodiment is, for example, positive (the average charge amount distribution is a positive value). The carrier liquid CL in this exemplary embodiment is a volatile solvent (for example, an isoparaffin-based oil). Herein, "volatile" is a property in which the flash point is less than 130° C. or in which the amount of volatilized portion after 24 hours at a temperature of 150° C. is more than 8% by mass. The flash point is measured according to JIS K2265-4 (2007).

Medium

The image forming apparatus 10 uses a ribbon-like (continuous) medium P. The medium P used in the image forming apparatus 10 is, for example, a thermoplastic resin film. Specifically, the medium P used in the image forming apparatus 10 according to this exemplary embodiment contains a thermoplastic resin. However, the material of the medium P used in the image forming apparatus 10 according to this exemplary embodiment may be made of any material, as long as it has a ribbon shape. For example, the medium P may be paper.

The image forming apparatus 10 includes a transport device 20, a toner-image forming part 30, drying devices 40, a fixing device 50, and a control device 60. Herein, the toner-image forming part 30 is an example of a forming part. The drying devices 40 are an example of a blowing part. The fixing device 50 is an example of a fixing part. In the description below, the rotation directions of the respective components of the image forming apparatus 10 are the directions indicated by arrows on the respective components. For example, the rotation direction of a photoconductor 32A is the direction indicated by an arrow on the photoconductor 32A.

Transport Device

The transport device 20 has functions of, for example, feeding a ribbon-like medium P into a transport path, transporting the medium P at a predetermined transport speed in the arrow A direction (transport direction), and winding the medium P having an image G2 formed thereon. The transport device 20 includes multiple transport rollers 22 and a winding part (not shown) for winding the medium P.

Toner-Image Forming Part

The toner-image forming part 30 has functions of developing, with the developer G, a latent image on the photoconductor 32A into a toner image G1 and transferring the toner image G1 to the medium P transported by the transport device 20. In other words, the toner-image forming part 30 has a function of forming, with the developer G, a toner image G1 on the (ribbon-like) medium P that is being transported. The toner-image forming part 30 includes a photoconductor unit 32, a developing device 34, and a transfer device 36.

Photoconductor Unit

The photoconductor unit 32 includes a photoconductor 32A, a charging device 32B, and an exposure device 32C. The photoconductor 32A has a function of carrying the toner image G1. The charging device 32B has a function of charging the photoconductor 32A, which revolves around the shaft. The exposure device 32C has a function of irradiating the photoconductor 32A, which has been charged by the charging device 32B, with light, thereby forming a latent image on the photoconductor 32A. The exposure device 32C forms the latent image on the photoconductor 32A, according to image data received from the control device 60.

Developing Device

The developing device 34 has a function of developing, with the developer G, the latent image on the photoconductor 32A into a toner image G1, at a nip NA (described below). The developing device 34 includes a supply roller 34A, a container 34B, a developing roller 34C, and a charging device 34D.

The supply roller 34A and the developing roller 34C form a nip NB therebetween. The supply roller 34A has a function of supplying the developer G to the developing roller 34C, while rotating about the shaft. The container 34B is an open-top container and has a function of accommodating the developer G therein. The supply roller 34A is disposed in such a manner that the lower part thereof is immersed in the developer G accommodated in the container 34B. The supply roller 34A transports the developer G attached to the outer circumferential surface thereof to the nip NB while being rotated about the shaft by a driving source (not shown) and supplies the developer G to the developing roller 34C. Note that the supply roller 34A receives a positive voltage applied to developing roller 34C from a power supply (not shown).

The developing roller 34C and the photoconductor 32A form a nip NA therebetween. The developing roller 34C has a function of developing, with the developer G supplied from the supply roller 34A, the latent image on the photoconductor 32A into a toner image G1 while rotating about the shaft. The developing roller 34C is driven by a driving source (not shown) and so as to rotate about the shaft. The developing roller 34C receives a positive voltage applied to the developing roller 34C from the power supply (not shown).

The charging device 34D has a function of charging, to positive polarity, the toner TN contained in the developer G on the developing roller 34C, which is rotating about the shaft. The charging device 34D according to this exemplary embodiment is disposed upstream of the nip NA and downstream of the nip NB in the rotation direction of the developing roller 34C, so as to face the developing roller 34C.

Transfer Device

The transfer device 36 has a function of transferring, to a medium P, the toner image G1 developed by the developing device 34 and carried by the photoconductor 32A. The transfer device 36 includes a first roller 36A and a second roller 36B.

The first roller 36A is cylindrical and extends parallel to the photoconductor 32A. The first roller 36A and the photoconductor 32A form a nip NC therebetween. The first roller 36A, while being driven by a driving source (not shown) to rotate about the shaft, allows the toner image G1 on the photoconductor 32A to be (first-) transferred to the outer circumferential surface thereof at the nip NC. The first roller 36A receives a negative voltage applied to the photoconductor 32A from a power supply (not shown).

The second roller 36B is cylindrical and extends parallel to the first roller 36A. The second roller 36B and the first roller 36A form a nip ND therebetween. The second roller 36B is rotated by the rotation of the first roller 36A about the shaft. The second roller 36B (second-) transfers the toner image G1, which has been transferred to the first roller 36A, to the medium P transported by the transport device 20. The second roller 36B receives a negative voltage applied to the first roller 36A by a power supply (not shown).

Drying Device

The drying devices 40 have a function of drying the medium P by evaporating a portion of the carrier liquid CL contained in the medium P having the toner image G1 transferred thereto by the transfer device 36. The drying devices 40 are disposed downstream of the toner-image forming part 30 and upstream of the fixing device 50 in the medium transport direction. The drying devices 40 are disposed on both sides of a medium transport path and are configured to blow warm air to the front and back surfaces of the medium P transported by the transport device 20. The warm air blown to the medium P by the drying devices 40 does not melt the toner TN constituting the toner image G1 transferred to the medium P.

Fixing Device

The fixing device 50 will be described with reference to FIGS. 1, 2, and 3. The fixing device 50 has a function of fixing, to the medium P, the toner image G1 transferred to the medium P by the transfer device 36, by applying heat and pressure to the medium P. Herein, "to fix the toner image G1 to the medium P" is "to melt the toner TN constituting the toner image G1 and fix the molten toner TN to the medium P". Hence, the thermal energy applied to the toner TN by the fixing device 50 is greater than that by the drying devices 40.

The fixing device 50 is disposed downstream of the drying devices 40, that is, downstream of the toner-image forming part 30, in the medium transport direction. As shown in FIGS. 1 and 2, the fixing device 50 includes a first fixing device 50A, a second fixing device 50B, and a third fixing device 50C, which are arranged in this order from the upstream side to the downstream side in the medium transport direction.

Figure 2:
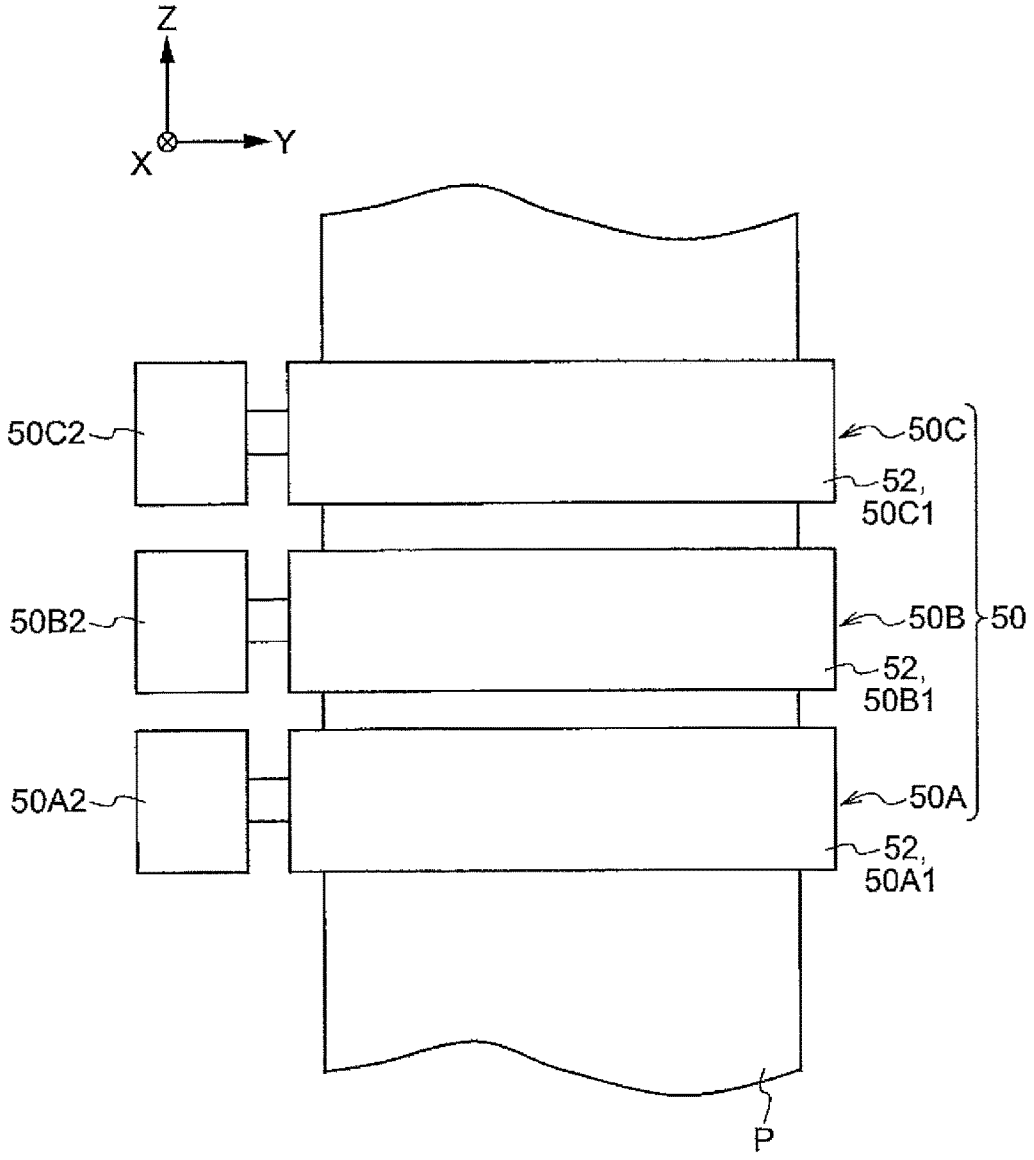
FIG. 2 is a schematic view (plan view), as viewed from the front surface side (image forming surface side) of a medium, of a fixing device constituting the image forming apparatus according to this exemplary embodiment, showing a state in which the fixing device performs a fixing operation on a medium that is being transported.

As shown in FIG. 2, the first fixing device 50A includes a fixing member 50A1 and a driving source 50A2. Herein, the driving source 50A2 is an example of a driving member. The fixing member 50A1 has a function of fixing the toner image G1 to the medium P by applying heat and pressure to the medium P. As shown in FIG. 1, the fixing member 50A1 includes a heating roller 52, a heat source 54, and a pressing roller 56. The heating roller 52 is rotated about the shaft by the driving source 50A2, while being heated by the heat source 54. The pressing roller 56 is disposed so as to oppose the heating roller 52, forming a nip N1 therebetween. The pressing roller 56 is driven by the heating roller 52 and applies pressure to the medium P passing through the nip N1. The heating roller 52 and the pressing roller 56 are arranged such that the heating roller 52 comes into contact with the surface of the medium P having the toner image G1 transferred thereto (i.e., the front surface) and the pressing roller 56 comes into contact with the back surface thereof.

As shown in FIGS. 1 and 2, the second fixing device 50B includes a fixing member 50B1 and a driving source 50B2, and the third fixing device 50C includes a fixing member 50C1 and a driving source 50C2. Herein, the driving sources 50B2 and 50C2 are an example of a driving member. The fixing members 50B1 and 50C1 have a function of fixing the toner image G1 to the medium P by applying heat and pressure to the medium P. The fixing members 50B1 and 50C1 have, for example, the same configuration as that of the first fixing device 50A. The pressing roller 52 of the fixing member 50B1 is driven by the driving source 50B2 so as to rotate about the shaft, and the pressing roller 52 of the fixing member 50C1 is driven by the driving source 50C2 so as to rotate about the shaft. In the description below, the nip formed by the fixing member 50B1 will be referred to as a nip N2, and the nip formed by the fixing member 50C1 will be referred to as a nip N3.

As has been described above, the fixing device 50 according to this exemplary embodiment has multiple fixing members (50A1, 50B1, and 50C1) for fixing the toner image G1 to the medium P by applying heat and pressure to the medium P. In this exemplary embodiment, the number of multiple fixing members (50A1, 50B1, and 50C1) is, for example, three.

Herein, the tension T between the nip ND (the position where the toner image G1 is formed) and the nip N1 is referred to as a tension T1, the tension T between the nip N1 and the nip N2 is referred to as a tension T2, the tension T between the nip N2 and the nip N3 is referred to as a tension T3, and the tension T on the downstream side of the nip N3 in the medium transport direction is referred to as a tension T4.

As has been described above, the fixing members 50A1, 50B1, and 50C1 have the same configuration. However, the driving torques applied from the driving sources 50A2, 50B2, and 50C2 to the fixing members 50A1, 50B1, and 50C1, respectively, are reduced in this order. The medium P is transported by the transport device 20 at a predetermined transport speed. Hence, as shown in FIG. 3, the tensions T in the medium P transported by the transport device 20 according to this exemplary embodiment has the following relationship: the difference between the tension T1 and the tension T2 (tension difference T1–T2) is greater than the difference between the tension T2 and the tension T3 (tension difference T2–T3), and the tension difference T2–T3 is greater than the difference between the tension T3 and the tension T4 (tension difference T3–T4). Specifically, in this exemplary embodiment, the upstream-downstream tension difference T1–T2, in the medium transport direction, of the fixing member 50A1 located on the most upstream side in the medium transport direction is greater than the upstream-downstream tension differences T2–T3 and T3–T4, in the medium transport direction, of the other fixing members 50B1 and 50C1, respectively. Herein, "the upstream sides and the downstream sides of the fixing members 50A1, 50B1, and 50C1 in the medium transport direction" are the portions immediately before and after the fixing members 50A1, 50B1, and 50C1 in the medium transport path. Furthermore, in this exemplary embodiment, the tension differences in the medium P are smaller on the further downstream side in the medium transport direction (in other words, the tension differences in the medium P are greater on the further upstream side in the medium transport direction, or, the tension difference T1–T2 on the most upstream side in the medium transport direction is greater than the other tension differences T2–T3 and T3–T4).

Control Device

The control device 60 has a function of controlling the respective components, except for the control device 60, of the image forming apparatus 10. The detailed function of the control device 60 will be described in the description of the operation of the image forming apparatus 10.

The above is the description of the configuration of the image forming apparatus 10.

Image Forming Operation

Next, the image forming operation according to this exemplary embodiment will be described with reference to FIG. 1.

The control device 60, upon receipt of image data from an external device (not shown), actuates the transport device 20, the toner-image forming part 30, the drying devices 40, and the fixing device 50.

Toner Image Formation on Medium by Toner-Image Forming Part

First, the control device 60 causes the supply roller 34A of the developing device 34 to rotate and supply the developer G to the developing roller 34C. Next, the control device 60 causes the developing roller 34C to rotate and causes the charging device 34D to charge the toner TN contained in the developer G on the developing roller 34C. Then, the control device 60 causes the charging device 32B to charge the photoconductor 32A and causes the exposure device 32C to form a latent image on the photoconductor 32A. Then, the control device 60 causes a power supply (not shown) to apply a voltage to the developing roller 34C. As a result, the latent image on the photoconductor 32A is developed as a toner image G1 at the nip NA.

Thereafter, the control device 60 causes a power supply (not shown) to apply a voltage to the first roller 36A of the transfer device 36, thereby first-transferring the toner image G1 developed on the photoconductor 32A to the first roller 36A. Then, the control device 60 causes a power supply (not shown) to apply a voltage to the second roller 82, thereby second-transferring the toner image G1, which has been first-transferred to the first roller 36A, to a medium P transported by the transport device 20 and passing through the nip ND. As a result, the toner image G1 is formed on the medium P, transported by the transport device 20, by the toner-image forming part 30.

Evaporation of Carrier Liquid in Medium by Drying Device

Next, the control device 60 causes the drying devices 40 to blow warm air to the medium P to which the toner image G1 has been transferred by the transfer device 36 and which is transported by the transport device 20. As a result, a portion of the carrier liquid CL contained in the medium P is evaporated, drying the medium P.

Fixing of Toner Image to Medium by Fixing Device

Next, the control device 60 causes the transport device 20 to transport the medium P, in which a portion of the carrier liquid CL has been evaporated by the drying devices 40, to the fixing device 50 and causes the respective fixing members 50A1, 50B1, and 50C1 to apply heat and pressure to the medium P passing through the nips N1, N2, and N3. As a result, the toner image G1 is fixed to the medium P that has passed through the fixing device 50 (an image G2 is formed on the medium P). Then, the medium P having the image G2 formed thereon is transported by the transport device 20 and is wound on a winding part (not shown), thus completing the image forming operation according to this exemplary embodiment.

The above is the description of the image forming operation according to this exemplary embodiment.

ADVANTAGE

Next, advantages (first and second advantages) of this exemplary embodiment will be described, while comparing with a comparative example described below. Note that, in the comparative example, the description will be given by using the same reference signs and names of the components as those used in this exemplary embodiment. In the description below, the section between the nip ND and the nip N1 will be referred to as a first section, the section between the nip N1 and the nip N2 will be referred to as a second section, and the section between the nip N2 and the nip N3 will be referred to as a third section.

First Advantage

The first advantage is provided by a feature in which, when the fixing device 50 includes multiple fixing members 50A1, 50B1, and 50C1 for fixing the toner image G1 to the medium P, the tension difference T1–T2 is greater than the tension differences T2–T3 and T3–T4. In other words, the first advantage is provided by a feature in which, when the fixing device 50 includes multiple fixing members 50A1, 50B1, and 50C1 for fixing the toner image G1 to the medium P, the driving force of the driving source 50A2 is greater than those of the driving sources 50B2 and 50C2.

In the image forming apparatus (not shown) according to the comparative example, the driving sources 50A2, 50B2, and 50C2 apply the same driving torque to the heating rollers 52 of the fixing members 50A1, 50B1, and 50C1, respectively. More specifically, in the comparative example, the driving torque applied to each heating roller 52 is equal to the driving torque applied to the heating roller 52 of the fixing member 50B1 according to this exemplary embodiment (see FIG. 4). As a result, in the comparative example, the tension differences T1–T2, T2–T3, and T3–T4 are equal (see FIG. 4). Except for this feature, the comparative example is the same as this exemplary embodiment.

Figure 4:
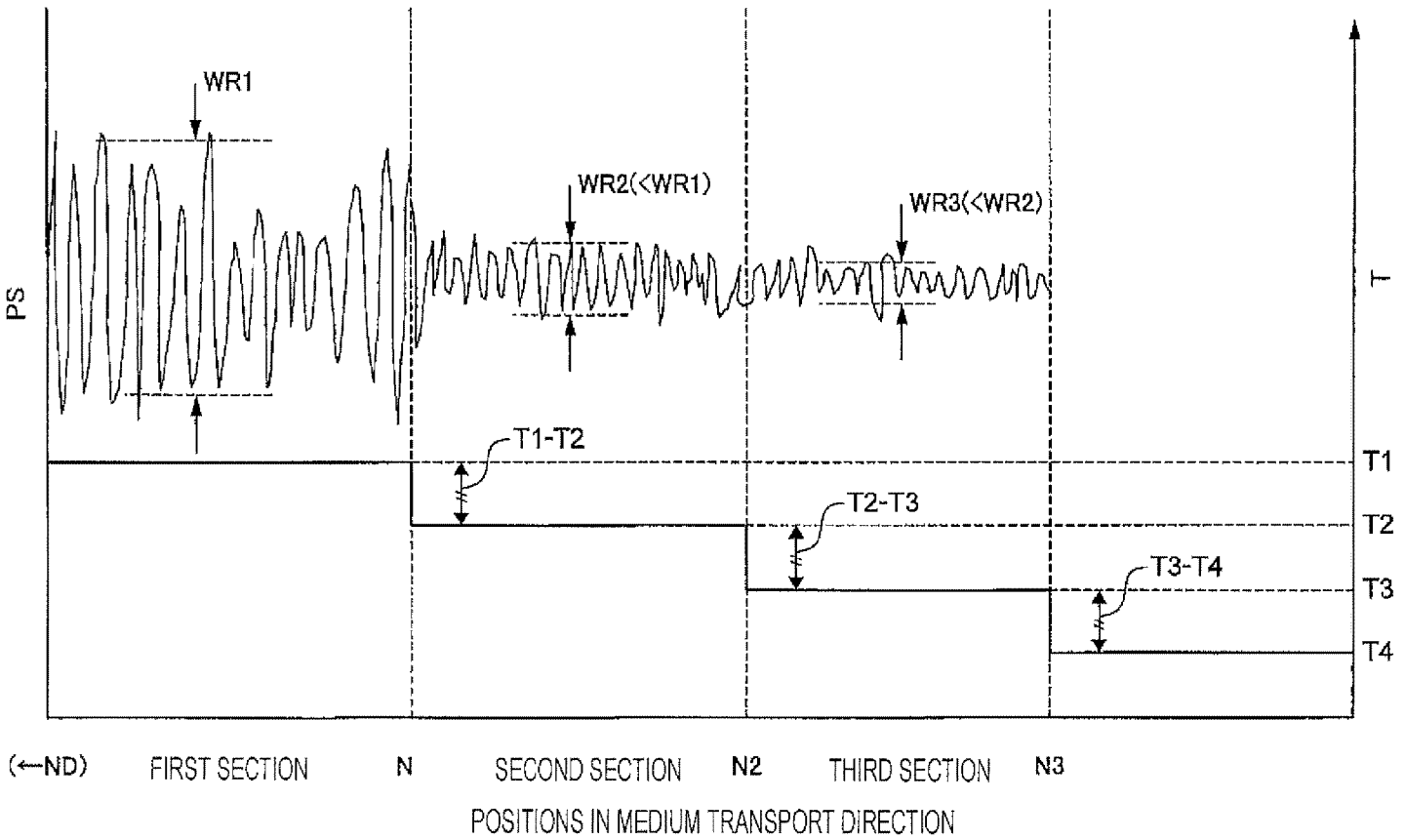
FIG. 4 shows, in the image forming apparatus according to a comparative example, the flap widths of the medium and the tensions in the medium at the respective positions in the medium transport direction.

Now, FIG. 4 will be described. FIG. 4 shows, in the image forming apparatus according to the comparative example, the degrees of flapping of the medium P in the thickness direction and the tensions T in the medium P at the respective positions in the medium transport direction. A first vertical axis PS shows an example position of the medium P in the width direction of the image forming apparatus 10, at the respective positions in the medium transport direction. Specifically, the medium P is transported while flapping by a flap width WR1 in the first section, a flap width WR2 in the second section, and a flap width WR3 in the third section. According to FIG. 4, the flap widths WR1, WR2, and WR3 are smaller in sections on the further downstream side in the medium transport direction.

When an image forming operation is performed with the image forming apparatus according to the comparative example, the following fixing defects may occur. Specifically, in the comparative example, the medium P is transported in a state in which the actual tension T is varied, due to flapping of the medium P by the flap width WR1 in the first section, and is nipped at the nip N1 of the fixing member 50A1. At the nip N1, the medium P is subjected to heat and pressure and, thus, becomes easily deformable. As a result, the medium P expands in the medium transport direction in a short time (the medium P repeats expansion and contraction in a short time). Consequently, the medium P is transported while expanding and contracting in the width direction of the medium P. As a result, in the comparative example, when an image is formed on the medium P, the medium P expands and contracts due to flapping of the medium P by the flap width WR1 in the first section, leading to a fixing defect in which the image is expanded or contracted. The fixing defect is more noticeable when the medium P is a thermoplastic resin film than when the medium P is paper. In addition, the fixing defect is more noticeable in the case where warm air is blown to the medium P by the drying devices 40 in the first section than in the case where no drying devices 40 are provided.

According to an examination performed by the inventors, if the temperature of the heating roller 52 is set to a temperature from 100° C. to 110° C., and the driving torque of the heating roller 52 of the fixing member 50A1 is set equal to that of the heating roller 52 of the fixing member 50B1, the expansion-and-contraction ratio fluctuation of the medium P in the transport direction is 0.3% to 0.55%. Herein, the expansion-and-contraction ratio fluctuation is the difference between the maximum value and the minimum value of the expansion-and-contraction ratio of the medium P in the medium transport direction.

Figure 3:
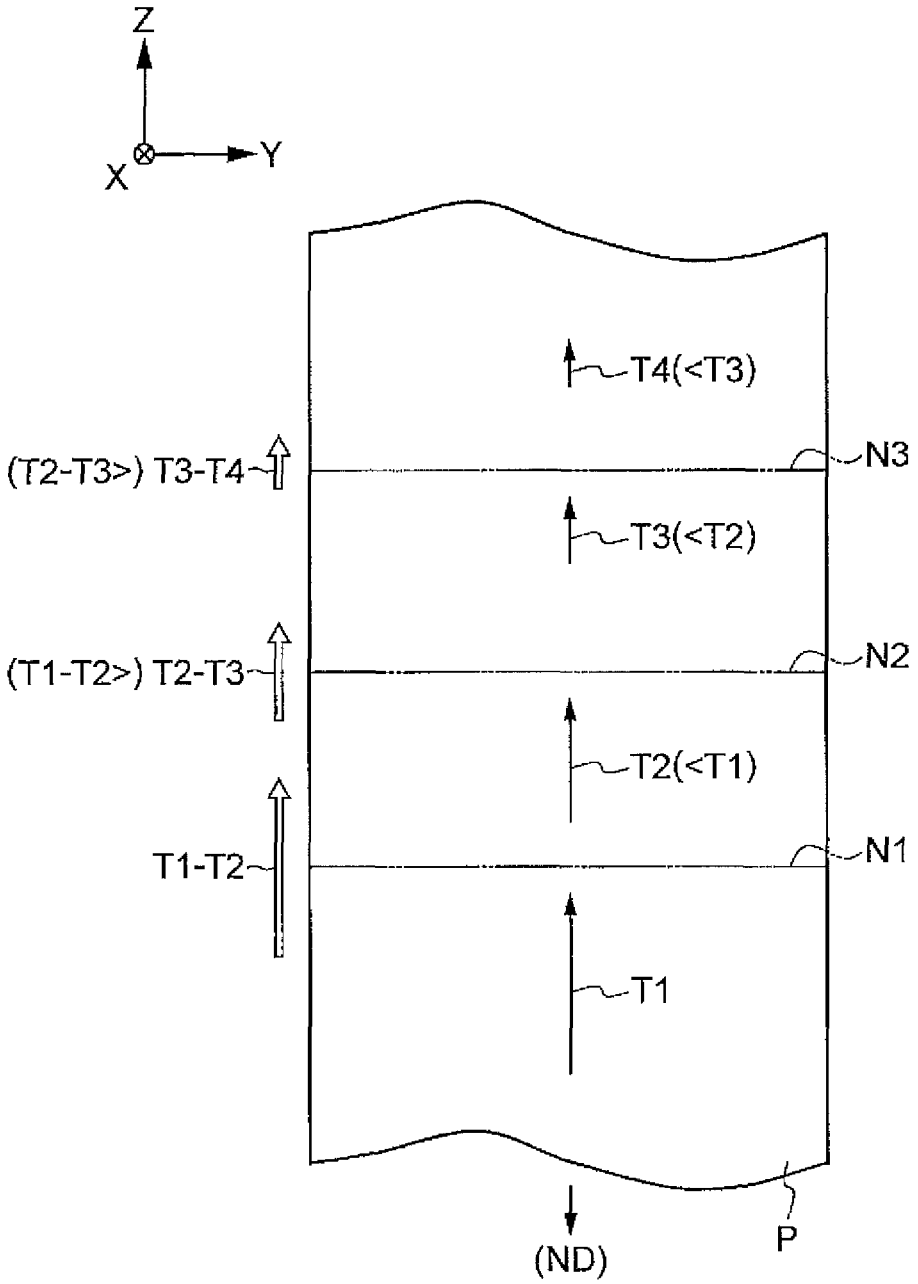
FIG. 3 shows the relationship between the positions of nips formed on a medium by multiple fixing members constituting the fixing device and the tensions applied to the medium, in the image forming apparatus according to this exemplary embodiment.
Figure 5:
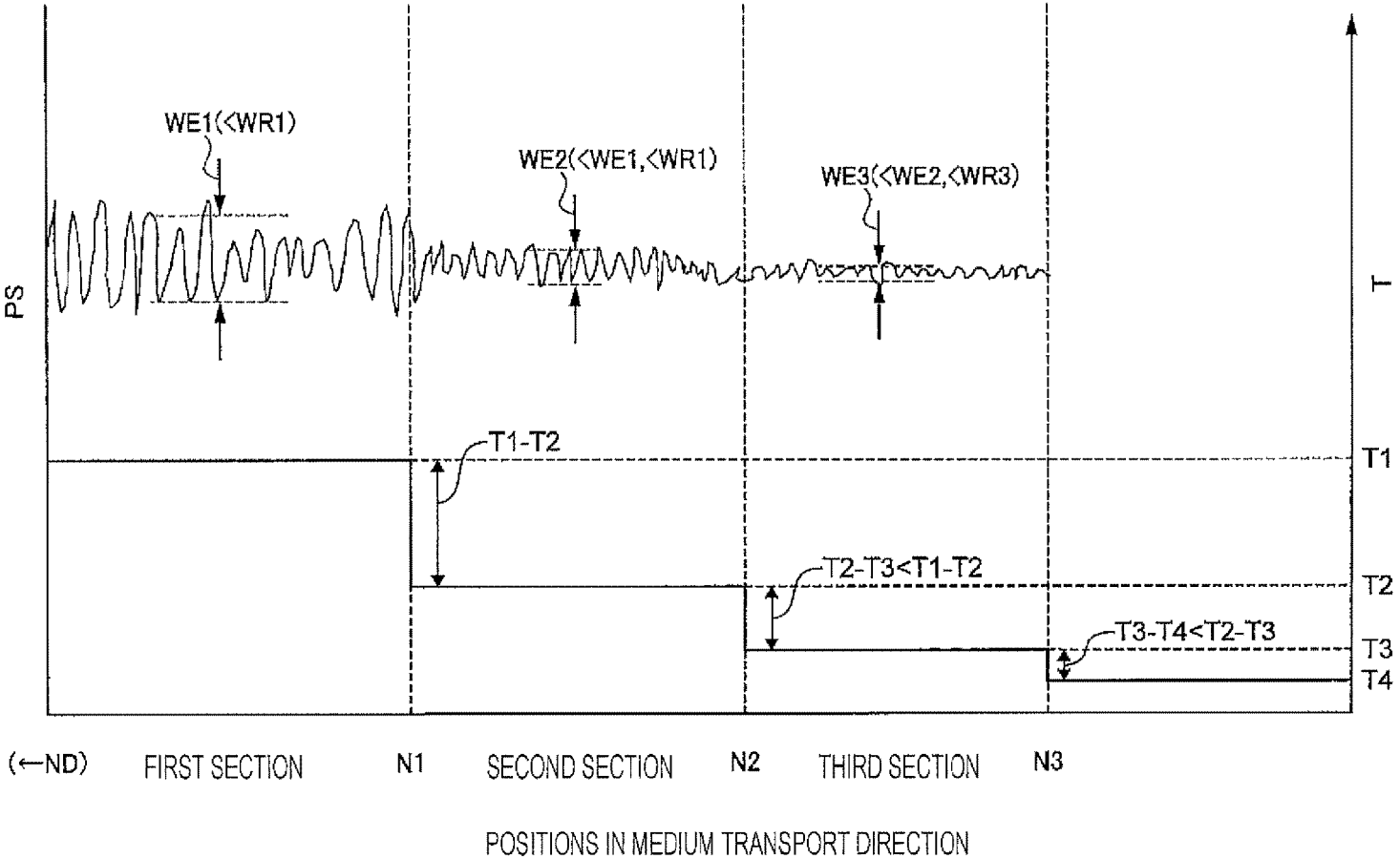
FIG. 5 shows, in the image forming apparatus according to this exemplary embodiment, the flap widths of the medium and the tensions in the medium at the respective positions in the medium transport direction.

In contrast, in this exemplary embodiment, as shown in FIGS. 3 and 5, when the fixing device 50 includes multiple fixing members 50A1, 50B1, and 50C1 for fixing the toner image G1 to the medium P, the tension difference T1–T2 is greater than the tension differences T2–T3 and T3–T4. Hence, the flap width WE1 of the medium P in the first section according to this exemplary embodiment can be made smaller than the flap width WR1 in the first section according to the comparative example (see FIGS. 4 and 5). Consequently, the flap width WE2 in the second section according to this exemplary embodiment can also be made smaller than the flap width WR2 in the second section according to the comparative example (see FIGS. 4 and 5).

According to an examination performed by the inventors, if the temperature of the heating roller 52 is set to a temperature from 100° C. to 110° C., and the driving force of the heating roller 52 of the fixing member 50B1 is set smaller by 15 (N/m) than that of the heating roller 52 of the fixing member 50A1, the expansion-and-contraction ratio fluctuation in the medium transport direction can be made 0.1% or less.

Accordingly, in this exemplary embodiment, it is possible to suppress fixing defects, compared with a case where the tension difference T1–T2 is equal to the tension differences T2–T3 and T3–T4. In this exemplary embodiment, it is possible to suppress fixing defects especially when the medium P is a thermoplastic resin film and when the drying devices 40 are provided in the first section.

Second Advantage

The second advantage is provided by a feature in which the number of multiple fixing members 50A1, 50B1, and 50C1 is three or more, and the tension differences between the upstream sides and the downstream sides of the fixing members 50A1, 50B1, and 50C1 in the medium transport direction are smaller on the further downstream side in the medium transport direction (in other words, the tension differences are greater on the further upstream side in the medium transport direction).

In the image forming apparatus according to the comparative example, as described above, the tension differences T1–T2, T2–T3, and T3–T4 are equal (see FIG. 4).

In the comparative example, the medium P flaps in the third section due to flapping of the medium P in the second section (see FIG. 5). The mechanism of how flapping of the medium P in the second section influences flapping of the medium P in the third section is the same as the mechanism of how flapping of the medium P in the first section influences flapping of the medium P in the second section, which has been described in the description of the first advantage given above.

In this exemplary embodiment, the tension differences between the upstream sides and the downstream sides of the fixing members 50A1, 50B1, and 50C1 in the medium transport direction are smaller on the further downstream side in the medium transport direction (see FIGS. 3 and 5).

Hence, in this exemplary embodiment, variations in the amount of expansion of the medium P are smaller than those in the case where the tension difference T1–T2 is equal to the tension differences T2–T3 and T3–T4. Although the number of the multiple fixing members 50A1, 50B1, and 50C1 is three in this exemplary embodiment, even if it is four or more, it may be considered that the same advantage is obtained. Specifically, in this exemplary embodiment, variations in the amount of expansion of the medium P are smaller than those in the case where the tension differences between the upstream sides and downstream sides of three or more fixing members in the medium transport direction are equal.

The above is the description of the advantage obtained with this exemplary embodiment.

Although the present invention has been described above by using a specific exemplary embodiment as an example, the present invention is not limited to the above-described exemplary embodiment. For example, the technical scope of the present invention includes the following embodiments.

In this exemplary embodiment, it has been described that the carrier liquid CL is volatile. However, the carrier liquid CL may be nonvolatile, as long as a toner image G1 is formed on a medium P by the toner-image forming part 30, serving as an example of a forming part.

In this exemplary embodiment, it has been described that the image forming apparatus 10 is an apparatus for forming a monochrome toner image. However, toner images G1 of different colors may be transferred by multiple toner-image forming parts 30, along the medium transport path.

In this exemplary embodiment, it has been described that the image forming apparatus 10 is an electrophotographic apparatus that forms an image using liquid developer G. However, the image forming apparatus may be an electrophotographic apparatus that forms an image using power developer, i.e., a so-called dry toner.

In this exemplary embodiment, it has been described that the image forming apparatus 10 is an electrophotographic apparatus and that the toner-image forming part 30 is an example of the forming part. However, as long as the forming part has a function of forming an image on a ribbon-like medium P, an example of the forming part does not need to be the toner-image forming part 30. For example, the forming part may be an ink jet head used in an ink jet image forming apparatus (not shown), instead of the toner-image forming part 30 according to this exemplary embodiment. Furthermore, the forming part may be a structure used in an offset printing apparatus (an example of an image forming apparatus) to form an image on a medium P, the structure including an ink roller, a blanket cylinder, and an impression cylinder, instead of the toner-image forming part 30 according to this exemplary embodiment.

In this exemplary embodiment, it has been described that a film containing a thermoplastic resin is an example of the medium P. However, even if the medium P is paper or a medium containing paper, the first and second advantages are considered to be achieved because, when the medium P is paper, the carrier liquid CL is absorbed in the paper, weakening the bond of the fibers constituting the paper and expanding the paper. However, if the medium P is paper or a medium containing paper, the tension differences in the medium P in the transport path are set to values different from those in this exemplary embodiment.

Furthermore, the tension differences in the medium P transported in the medium transport path may be set to different values between when the image forming operation is performed using paper or a medium containing paper as a medium P and when the image forming operation is performed using a thermoplastic resin film as a medium P, as in this exemplary embodiment. For example, it may be configured such that the tension-difference relationship is changed when a user inputs the type of the medium P used in the image forming apparatus 10 via an interface (not shown) of the image forming apparatus 10.

In this exemplary embodiment, it has been described that the image forming apparatus 10 includes the drying devices 40 (see FIG. 1). However, the drying devices 40 may be omitted.

In this exemplary embodiment, it has been described that the fixing members 50A1, 50B1, and 50C1 each include the heating roller 52 and the pressing roller 54. However, as long as there are multiple fixing members arranged in the medium transport direction, the members that apply heat and pressure in the fixing members do not necessarily have to be rollers, but may be, for example, belts.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a forming part that forms an image on a continuous medium that is being transported; and a fixing part disposed downstream of the forming part in a medium transport direction, the fixing part including a plurality of fixing members, which are arranged in the transport direction and fix the image to the medium by applying heat and pressure to the medium, wherein an upstream-downstream tension difference, in the medium transport direction, of the fixing member located on the most upstream side in the transport direction is greater than upstream-downstream tension differences of the other fixing members in the medium transport direction, and wherein the tension between each of the fixing members in the plurality of fixing members is different, such that the tension is higher on the upstream side in the medium transport direction and decreases towards the downstream side in the medium transport direction.

2. The image forming apparatus according to claim 1, wherein the number of the plurality of fixing members is three or more.

3. An image forming apparatus comprising:

a forming part that forms an image on a continuous medium that is being transported; and a fixing part disposed downstream of the forming part in a medium transport direction, the fixing part including a plurality of fixing members, which are arranged in the medium transport direction and fix the image to the medium by applying heat and pressure to the medium, and driving members for driving the plurality of fixing members by applying driving forces thereto, wherein the driving force applied by a corresponding driving member for driving the fixing member located on the most upstream side in the medium transport direction is greater than driving forces for driving the other fixing members, and wherein tension between each of the fixing members in the plurality of fixing members is different, such that the tension is higher on the upstream side in the medium transport direction and decreases towards the downstream side in the medium transport direction.

4. The image forming apparatus according to claim 3, wherein the number of the plurality of fixing members is three or more, and the driving forces applied by the driving members for driving the fixing members are greater on the further upstream side than the downstream side in the transport direction.

5. The image forming apparatus according to claim 1, wherein the medium contains a thermoplastic resin.

6. The image forming apparatus according to claim 2, wherein the medium contains a thermoplastic resin.

7. The image forming apparatus according to claim 3, wherein the medium contains a thermoplastic resin.

8. The image forming apparatus according to claim 4, wherein the medium contains a thermoplastic resin.

9. The image forming apparatus according to claim 1, further comprising a blowing part for blowing warm air to the medium, the blowing part being disposed downstream of the forming part and upstream of the fixing part in the transport direction, wherein the forming part forms the image on the medium by using a developer containing a toner and a carrier liquid.

10. The image forming apparatus according to claim 2, further comprising a blowing part for blowing warm air to the medium, the blowing part being disposed downstream of the forming part and upstream of the fixing part in the transport direction, wherein the forming part forms the image on the medium by using a developer containing a toner and a carrier liquid.

11. The image forming apparatus according to claim 3, further comprising a blowing part for blowing warm air to the medium, the blowing part being disposed downstream of the forming part and upstream of the fixing part in the transport direction, wherein the forming part forms the image on the medium by using a developer containing a toner and a carrier liquid.

12. The image forming apparatus according to claim 4, further comprising a blowing part for blowing warm air to the medium, the blowing part being disposed downstream of the forming part and upstream of the fixing part in the transport direction, wherein the forming part forms the image on the medium by using a developer containing a toner and a carrier liquid.

13. The image forming apparatus according to claim 5, further comprising a blowing part for blowing warm air to the medium, the blowing part being disposed downstream of the forming part and upstream of the fixing part in the transport direction, wherein the forming part forms the image on the medium by using a developer containing a toner and a carrier liquid.

14. The image forming apparatus according to claim 6, further comprising a blowing part for blowing warm air to the medium, the blowing part being disposed downstream of the forming part and upstream of the fixing part in the transport direction, wherein the forming part forms the image on the medium by using a developer containing a toner and a carrier liquid.

15. The image forming apparatus according to claim 7, further comprising a blowing part for blowing warm air to the medium, the blowing part being disposed downstream of the forming part and upstream of the fixing part in the transport direction, wherein the forming part forms the image on the medium by using a developer containing a toner and a carrier liquid.

16. The image forming apparatus according to claim 8, further comprising a blowing part for blowing warm air to the medium, the blowing part being disposed downstream of the forming part and upstream of the fixing part in the transport direction, wherein the forming part forms the image on the medium by using a developer containing a toner and a carrier liquid.

* * * * *